US008181831B2

(12) United States Patent
Chapin

(10) Patent No.: US 8,181,831 B2
(45) Date of Patent: May 22, 2012

(54) CONTAINER AND ASSOCIATED DISPENSER FOR LIQUID MATERIALS

(76) Inventor: Joseph Powell Chapin, Bethesda, MD (US)

( * ) Notice: Subject to any disclaimer, the term of this patent is extended or adjusted under 35 U.S.C. 154(b) by 456 days.

(21) Appl. No.: 12/467,551

(22) Filed: May 18, 2009

(65) Prior Publication Data

US 2010/0288794 A1 Nov. 18, 2010

(51) Int. Cl.
*B67D 7/60* (2010.01)
*B67D 7/58* (2010.01)

(52) U.S. Cl. ..... 222/377; 222/321.5; 222/321.7; 222/464.7

(58) Field of Classification Search ..... 222/320, 222/321.1, 321.5, 321.7, 372, 377, 382, 464.1, 222/464.3, 464.7
See application file for complete search history.

(56) References Cited

U.S. PATENT DOCUMENTS 2,932,433 A 4/1960 Abplanalp
3,618,829 A * 11/1971 Elmore et al. ..... 222/209
4,930,652 A 6/1990 Murphy et al.
5,062,549 A 11/1991 Smith et al.
5,244,112 A 9/1993 Murphy et al.
5,366,119 A 11/1994 Kline
5,464,129 A 11/1995 Ho
5,522,548 A * 6/1996 Gallien et al. ..... 239/337
5,655,714 A * 8/1997 Kieffer et al. ..... 239/318
5,848,721 A 12/1998 Cornell et al.
6,193,101 B1 2/2001 Murphy et al.
6,257,446 B1 7/2001 Pike
6,648,201 B1 11/2003 Marinaro et al.
6,752,297 B1 6/2004 Ische
6,834,815 B2 12/2004 Appleby
7,048,156 B2 5/2006 Weck et al.
7,402,092 B1 7/2008 Randall et al.
2003/0197029 A1 * 10/2003 Petit et al. ..... 222/321.7
2004/0112922 A1 * 6/2004 Ouellette ..... 222/382
2005/0155990 A1 7/2005 Gardiner
2007/0138209 A1 * 6/2007 Knauer et al. ..... 222/207
2008/0023499 A1 1/2008 Knight
2008/0169316 A1 * 7/2008 Ganiere ..... 222/464.3

* cited by examiner

*Primary Examiner* — Darren W Gorman
(74) *Attorney, Agent, or Firm* — Millen, White, Zelano, Branigan, P.C.

(57) ABSTRACT

A container and associated dispenser for liquid is configured to dispense residual liquid from the container after the bulk of liquid has been dispensed from the container. This is accomplished by having a conical projection on the bottom of the container which causes residual liquid to flow into a gutter defined by the wall of the container and the surface of the conical projection. A dip-tube is connected to the dispenser and is rotatable in order to revolve the open free end of the dip-tube to access any circumferential location in the gutter in order to pick up residual liquid.

10 Claims, 4 Drawing Sheets

CONTAINER AND ASSOCIATED DISPENSER FOR LIQUID MATERIALS

FIELD OF THE INVENTION

This invention relates to containers and associated dispensers for liquid material, and more particularly, this application relates to containers and associated dispensers for liquid material wherein dip-tubes extend from the dispensers into the liquid material in such a way as to remove portions of the liquid material remaining on the bottom of containers after the bulk of liquid material has been dispensed from the containers.

BACKGROUND OF THE INVENTION

Fluid dispensers containing liquid materials such as liquid soap, shampoo, hand cream, lotions and the like are dispensed from containers by pumping action on dip-tubes which pull liquid material from the bottom of the containers. After the bulk of the liquid material has been dispensed there are frequently residual amounts of liquid left in the containers which represent an unnecessary waste to the consumer. As is evident from the Information Disclosure Statement there are numerous patents directed to removing residual amounts of liquid material, however these patents are not efficacious for both handheld and stationary containers and usually require that the containers be lifted and tilted. There are now also containers, frequently containing liquid soap, which preferably remains standing on a countertop during use, frequently next to a sink. It is not necessarily desired to lift and tilt these containers to dispense residual liquid soap. Consequently, the containers are disposed of with residual amounts of liquid soap therein. On the other hand, it may not bother a consumer to lift such containers up to dispense residual liquid soap therein. Accordingly there is a need for a container and an associated dispenser configured for both situations.

SUMMARY OF THE INVENTION

In view of the aforementioned considerations, a container and associated dispenser having a pump for liquid materials is configured with a dip-tube that extends to the bottom of the container, the bottom of the container having a convex projection that channels the liquid material to a gutter. The dip-tube is rotatable so as to revolve an open end of the dip-tube in the gutter, so that when the pump is operated, residual liquid material remaining in the gutter is pulled up and dispensed out through the nozzle.

Certain embodiments of the container and associated dispenser of the present invention have a turning arrangement which comprises a disk rotatably mounted with respect to a closure for the container.

In another embodiment of the container and associated dispenser of the present invention, the closure for the top opening of the container can be a threaded cap having a top surface with a hole through which the offset portion of the dip-tube extends and is rotatable with respect thereto.

In a further aspect of the invention, the container and associated dispenser for liquid materials comprises a container having a sidewall, bottom wall and a top opening forming an enclosure for the liquid material. The bottom wall has a projecting surface therein sloping down to a gutter forming a sump that is disposed adjacent to the sidewall. The top opening includes an arrangement thereon for mounting the dispenser. The dispenser comprises a liquid pump having an outlet. A dip-tube extends from the pump and has a lower open end positioned in the gutter for pulling liquid from the gutter upon operating the pump. The pump is mounted on a pump support that is rotatably mounted with respect to the dip-tube. A turning arrangement is mounted proximate to the top opening of the container and is fixed to the dip-tube for rotating the dip-tube to revolve the lower open end of the dip-tube around the projecting surface to access all circumferential locations in the gutter, whereby substantially all residual portions of the liquid can be pumped from the container.

In a further aspect of the arrangement, the container is cylindrical and the projecting surface is a cone having an apex.

In a further aspect of the arrangement, the gutter is defined by the side wall and the projecting surface.

In a further aspect of the arrangement, the bottom of the gutter is defined by the juncture of the sidewall and the projecting surface.

In a further aspect of the arrangement, a mounting cap closes the top opening of the container and the turning arrangement is disposed between the mounting cap and dispenser.

In a further aspect if the arrangement, the lower open end of the dip-tube is slanted so that the dip-tube pulls substantially all of the liquid from the gutter.

In a further aspect of the arrangement, the pump support is a tubular projection rotatably received in the dip-tube.

In a further aspect of the arrangement, the liquid material is liquid soap.

In still a further aspect of the invention the turning arrangement is a dial mounted on a closure for the container and integral with the dip-tube.

BRIEF DESCRIPTION OF THE DRAWINGS

Various other features and attendant advantages of the present invention will be more fully appreciated as the same becomes better understood when considered in conjunction with the accompanying drawings, in which the reference characters designate the same or similar parts throughout the several views, and wherein.

DETAILED DESCRIPTION OF THE DRAWINGS

Figure 1:
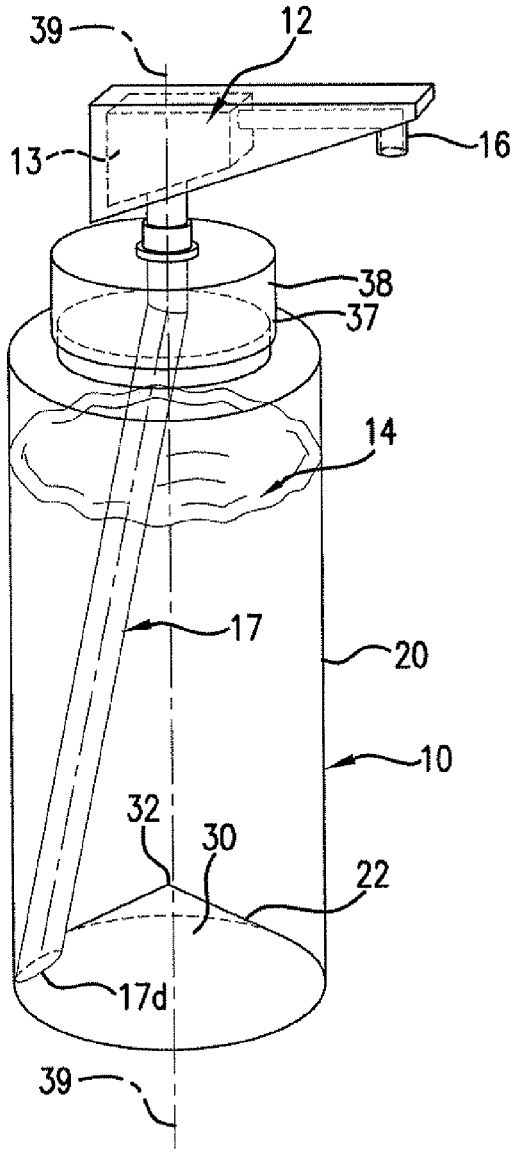
FIG. 1 is a perspective view of the container and associated dispenser for liquid materials with a dip-tube in a first position and with portions in phantom.
Figure 2:
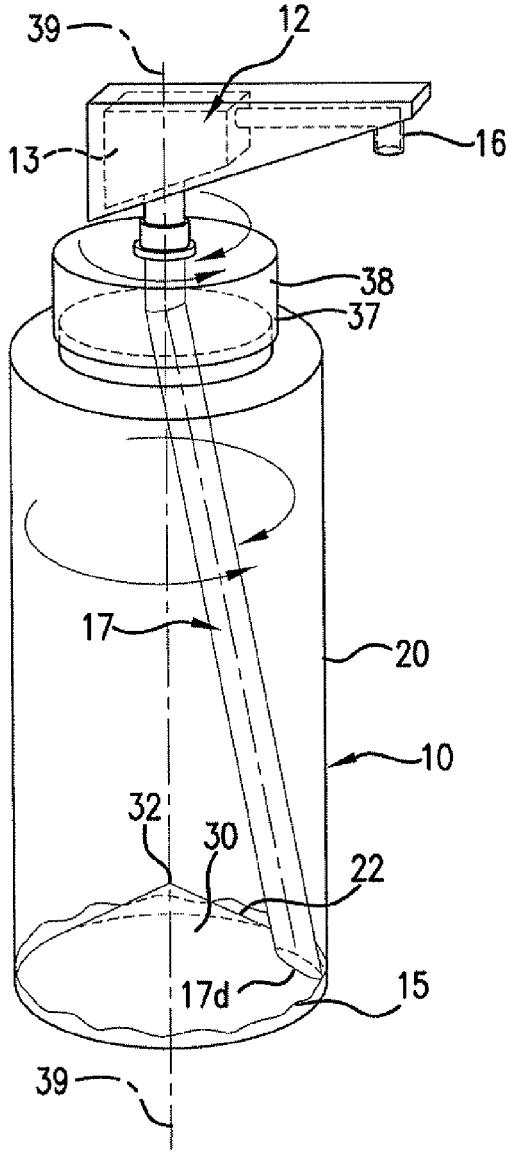
FIG. 2 is a perspective view similar to FIG. 1, but showing the dip-tube rotated to another position.

Referring to FIGS. 1 and 2, a container 10 has an associated dispenser 12 having a liquid pump 13 of a conventional type for dispensing a liquid material 14 from the container and through a spout 16. As is seen in FIG. 2, after the bulk of the liquid material 14 is dispensed from the container 10, a residual portion 15 of the liquid material remains at the bottom of the container. According to the present invention, the residual portion 15 is removed by a dip-tube 17 connected to the dispenser 12. If the residual portion of the material 15 is not all in one location, the dip-tube 17 can be moved to various locations on the bottom of the container 10 so that substantially all residual portions 15 of the liquid material 14 may be removed.

Figure 3:
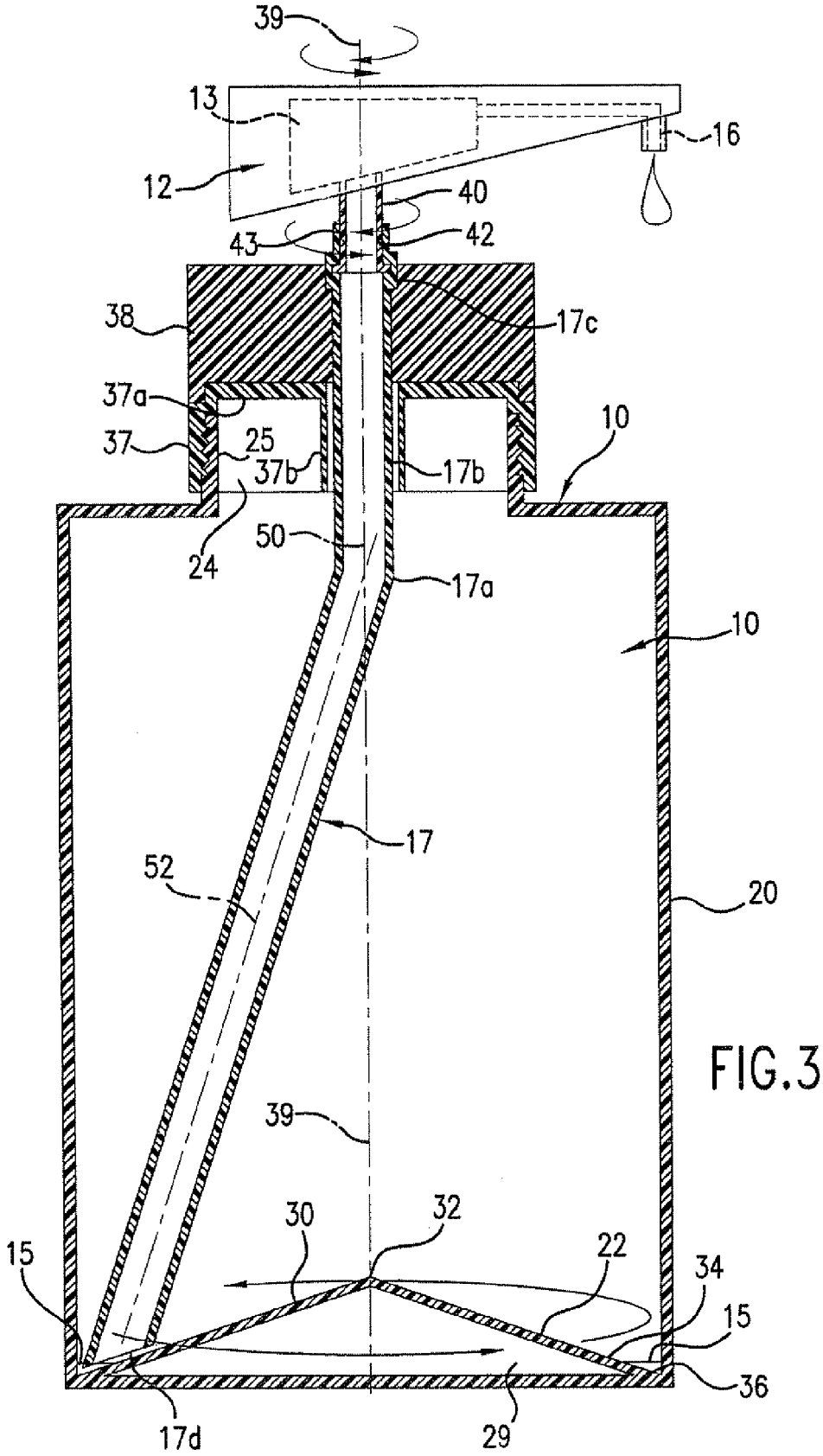
FIG. 3 is an elevation of the container and associated dispenser for liquid materials shown in FIGS. 1 and 2, the elevation being taken along lines 3-3 of FIG. 1.
Figure 4:
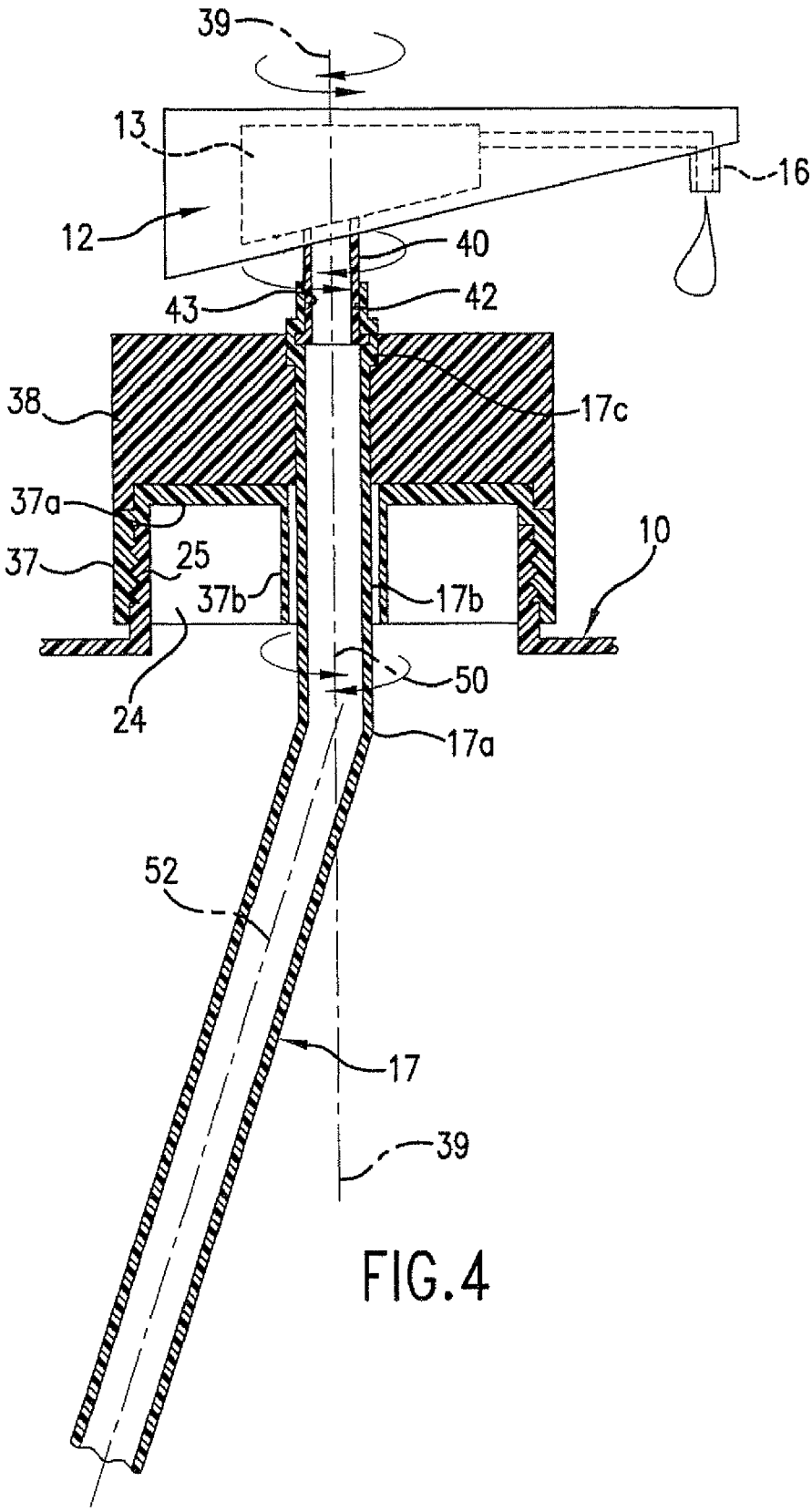
FIG. 4 is an enlarged view of a dial, mounting collar and dip-tube employed in FIG. 3.

FIGS. 3 and 4 in combination with FIGS. 1 and 2 show the container 10 and dispenser 12 in more detail. As seen in these figures, the container 10 has a sidewall 20, a bottom 22 and a top opening 24 defined by a threaded neck 25 so as to form an enclosure for the liquid material 14. The bottom wall 22 is defined by a conical projection 29 having a conical projecting surface 30 thereon sloping down from an apex 32 to a sump 34 in the form of a circular gutter 36. The gutter 36 is disposed adjacent to the sidewall 20 and has an angular configuration in cross-section so as to accumulate the residual liquid 15 after the bulk of the liquid material 14 has been dispensed from the container 10. The residual liquid 15 is removed from the container 10 by pulling the residual liquid through the dip-tube 17 with the pump 13 and conveying the residual liquid 15 to and out of the spout 16 of the dispenser 12. The top opening 24 defined by the threaded neck 25 has a mounting cap 37 threaded thereon to provide a closure for the container 10 and to support the dispenser 12. The mounting cap 37 has a top surface 37*a* with a sleeve 37*b*, through which sleeve a portion of the dip-tube 17 is rotatably received.

Referring now more specifically to FIGS. 3 and 4, the dip-tube 17 has a bend 17*a* therein so as to have an axially offset portion 17*b* that is rotatably received through the mounting cap 37 and is fixed by projections 17*c* to a dial 38. The dial 38 is rotatable about an axis 39 so as to be rotatable with respect to the fixed mounting cap 37. Consequently, rotation of the dial 38 rotates the offset portion 17*b* of the dip-tube 17 while the mounting cap 37 remains stationary on the container 10.

The dip-tube 17 has two axes, the first being an axis 50 that coincides with the axis 39 and about which the offset portion 17*b* rotates and the dip-tube 17 revolves, and the second being axis 52 which is at an obtuse angle with axis 50.

The dispenser 12 is rotatably mounted within the offset portion 17*b* of the dip-tube 17 by a mounting tube 40 which aligns with the longitudinal axis 39 of the container 10, which axis 39 also passes through the apex 32 of the conical projecting surface 30. The dispenser 12 is free to rotate about the axis 39 because the mounting tube 40 can rotate within the offset portion 17*b* of dip-tube 17. A seal 42 seals between the offset portion 17*b* of the dip-tube 17 and the mounting tube 40. The seal 42 may seat within a circumferential groove 43 in the mounting tube 40, or be exteriorly positioned on the offset portion 17*b* of the dip-tube 17 while engaging the mounting tube 40.

While the container 10 in a preferred embodiment is cylindrical and the projecting surface 30 is in the preferred embodiment conical, these structures may have other shapes as long as the liquid material is directed into a gutter that is accessible by the open end 17*d* of the dip-tube 17.

Figure 5:
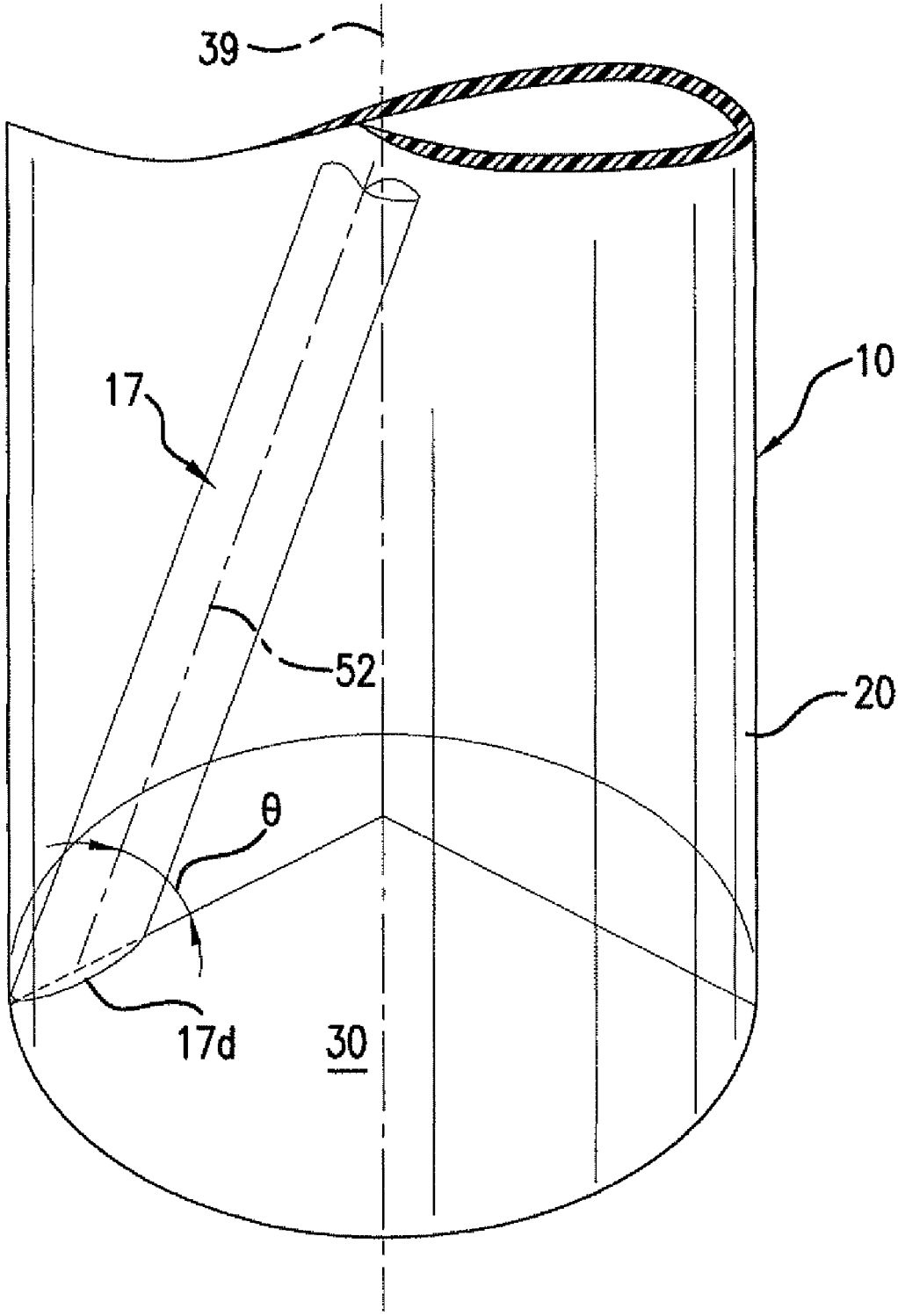
FIG. 5 is an enlarged view showing the configuration of an open end of the dip-tube.

Referring now to FIG. 5, it is seen that the open end 17*d* of the dip-tube 17 is preferably disposed at an angle θ to the axis of the dip-tube 17 so that the open end is parallel to the conical surface 30 of the conical projection 29.

In summary, the dispenser 12 is rotatable independent of the offset portion 17*b* of the dip-tube 17. The dip-tube 17 is free to rotate about the axis 39 of the container 10 so that its free end 17*d* revolves about the axis 39 with the free end 17*d* of the dip-tube 17 in the gutter 36. The sloping surface of the conical projection 29 always drains the residual liquid material 15 into to the gutter 36. Consequently, the free end 17*d* of the dip-tube 17 can pull up residual liquid material 15 from substantially any location in the gutter 36.

From the foregoing description, one skilled in the art can easily ascertain the essential characteristics of this invention, and without departing form the spirit and scope thereof, can make various changes and modifications of the invention to adapt it to various usages and conditions.

I claim:

1. A container and associated dispenser for liquid materials comprising:

a container having a sidewall, bottom wall and a top opening, the container forming an enclosure for the liquid material; the bottom wall having a sloping projecting surface therein sloping down to a gutter forming a sump disposed adjacent to the sidewall, and the top opening including an arrangement thereon for mounting a dispenser;

a dispenser mounted on the container, the dispenser having a liquid pump, a spout and a dip-tube, the dip-tube having a lower open end slanted to confirm to the sloping projecting surface, the lower open end positioned in the gutter for pulling liquid from the gutter upon operating the liquid pump, the dispenser being mounted on a dispenser support, and a turning arrangement mounted proximate the top opening of the container, the turning arrangement being fixed to the dip-tube for rotating the dip-tube so as to revolve the lower open end of the dip-tube about the sloping projecting surface to access substantially all circumferential locations in the gutter, whereby residual portions of the liquid material can be pulled into the tube upon operating the pump to remove the residual portions of the liquid material from the gutter of the container so that the residual portions are expelled from the container through the spout on the dispenser.

2. The container and associated dispenser of claim 1, wherein the container is cylindrical and the projecting surface is conical.

3. The container and associated dispenser of claim 2 wherein the projecting conical surface has an apex aligned with a first axis of the dip-tube, about which first axis the dip-tube rotates.

4. The container and associated dispenser of claim 3 wherein the dip-tube has a bend so as to extend along a second axis from the bend to the open end of the dip-tube.

5. The container and associated dispenser of claim 1 wherein the turning arrangement comprises a disk rotatably mounted with respect to a closure for the container.

6. The container and associated dispenser of claim 5, wherein the closure of the container is a threaded cap having a top surface with a hole through which an offset portion of the dip-tube extends and is rotatable with respect thereto.

7. The container and associated dispenser of claim 1 wherein the gutter is partially defined by the sidewall of the container.

8. The container and associated dispenser of claim 1, wherein a bottom of the gutter is defined by a juncture of the sidewall and the projecting surface.

9. The container and associated dispenser of claim 1, wherein the pump dispenser support is a tubular projection rotatably received in the dip-tube.

10. The container and associated dispenser of claim 1, wherein the liquid material is liquid soap.

* * * * *